US009551108B2

(12) United States Patent
Feng

(10) Patent No.: US 9,551,108 B2
(45) Date of Patent: Jan. 24, 2017

(54) DISPERSION MACHINE FOR REMOVING IMPURITIES FROM FIBER

(71) Applicant: Xiujuan Feng, Zhucheng (CN)

(72) Inventor: Xiujuan Feng, Zhucheng (CN)

( * ) Notice: Subject to any disclaimer, the term of this patent is extended or adjusted under 35 U.S.C. 154(b) by 0 days.

(21) Appl. No.: 14/431,938

(22) PCT Filed: Aug. 29, 2013

(86) PCT No.: PCT/CN2013/082514

§ 371 (c)(1),
(2) Date: Mar. 27, 2015

(87) PCT Pub. No.: WO2014/048210

PCT Pub. Date: Apr. 3, 2014

(65) Prior Publication Data

US 2015/0252528 A1 Sep. 10, 2015

(30) Foreign Application Priority Data

Sep. 29, 2012 (CN) ..... 2012 1 0372616

(51) Int. Cl.
*D21B 1/34* (2006.01)
*D21B 1/06* (2006.01)
(Continued)

(52) U.S. Cl.
CPC ..... *D21B 1/061* (2013.01); *D21B 1/34* (2013.01); *D21D 1/004* (2013.01); *B07B 1/20* (2013.01)

(58) Field of Classification Search
CPC ..... D21D 1/004; D21D 5/02; D21D 5/18; D21D 5/20; D21D 5/22; D21B 1/34; D21B 1/06; D21B 1/061; B07B 1/20
See application file for complete search history.

(56) References Cited

U.S. PATENT DOCUMENTS 3,577,999 A * 5/1971 Pinkham ..... A24C 5/36 131/312
3,807,646 A * 4/1974 Leiter ..... B02C 19/0056 241/154

(Continued)

FOREIGN PATENT DOCUMENTS

CN 1216483 A 5/1999
CN 2467560 Y 12/2001

(Continued)

OTHER PUBLICATIONS

International Search Report issued in PCT/CN2013/082514, mailed on Nov. 28, 2013.

*Primary Examiner* — Joseph C Rodriguez
(74) *Attorney, Agent, or Firm* — Birch, Stewart, Kolasch & Birch, LLP

(57) ABSTRACT

A dispersion machine for removing impurities from a fiber which includes a housing, a feed port and a discharge port arranged on the housing, and several processing components arranged in the housing wherein the processing component includes a connection portion and a scraping portion. When the processing component moves, the scraping portion is adapted to contact the fiber and moves relative to a surface of the fiber so as to remove impurities from the fiber surface. A feed screw rod and a discharge screw rod for processing material are also arranged in the housing to repeatedly feed material, discharge material and remove impurities form the fiber surface. The dispersion machine can be used to remove impurities from fiber in the papermaking field, textile field and the like, so as to obtain a raw material with a low impurity content.

13 Claims, 6 Drawing Sheets

(51) Int. Cl.
*D21D 1/00* (2006.01)
*B07B 1/20* (2006.01)

(56) References Cited

U.S. PATENT DOCUMENTS 4,501,047 A * 2/1985 Wrassman ..... D01G 9/04 19/145.5
5,443,213 A * 8/1995 Aikawa ..... D21B 1/32 209/234
5,513,805 A * 5/1996 Fisher ..... B07B 1/20 209/23
5,529,247 A * 6/1996 Mleczewski ..... E01C 19/104 222/227
5,687,923 A * 11/1997 Ide ..... D21B 1/325 241/260.1
5,947,645 A * 9/1999 Rixom ..... B01F 7/30 222/58
6,629,653 B2 * 10/2003 Fahrbach ..... B02C 13/13 209/300
7,097,044 B2 * 8/2006 Gutierrez ..... B03B 5/32 209/305
8,641,909 B2 * 2/2014 Arbuthnot ..... B01D 21/06 210/528
2002/0079250 A1 6/2002 Fahrbach et al.
2015/0176204 A1 * 6/2015 Miyazawa ..... B07B 9/00 162/263
2015/0314486 A1 * 11/2015 Hayashi ..... B29B 17/02 241/19

FOREIGN PATENT DOCUMENTS

CN 2711215 Y 7/2005
CN 2839340 Y 11/2006
CN 201183014 Y 1/2009
CN 201546111 U 8/2010
CN 201990604 U 9/2011
CN 102635012 A 8/2012
GB 2 099 325 A 12/1982

* cited by examiner

DISPERSION MACHINE FOR REMOVING IMPURITIES FROM FIBER

TECHNICAL FIELD

The invention relates to a dispersion machine for removing impurities from fiber and belongs to the mechanical field of fiber products.

BACKGROUND

The materials used in the papermaking field, textile field and the like generally comprise impurities like gooey, grease, paraffin, plastic, etc. which can reduce the quality of fiber products, so it's necessary to remove them during the manufacturing processes.

The impurities in the materials are generally mixed with fibers, so the key step during the impurities removal is to strip impurities from fiber. In existing technology, The Chinese patent CN2711215Y adopting a hydrapulper to remove impurities disclosed a twin scroll hydrapulper, comprising a tub, a feed port, a reducer, a disk-cutter, a sieve plate, a discharge port for impurities, a discharge port for pulp and a motor. The cutter shafts driven by the motor are crossly arranged on the two sides of the tub in parallel, the disk-cutters are arranged thereon; the sieve plates are arranged on the outside of the disk-cutters; the reducer arranged between the cutter shaft and the motor has an meshing spiral bevel gear arranged therein. Two pulping units, filter units and discharge ports are arranged on two sides of the twin scroll hydrapulper, and the two pulping units generating twin scroll interaction are arranged on different side and not coaxial, but rotate with the same speed and direction. When hydrapulper is running, the pulp led by the disk-cutters moves fast and the impurities on fiber are stripped by the interaction generated by the relative motion of the pulp and fiber, however, a small interaction force is generated because of the low speed of the relative motion, so the impurities on fiber cannot be removed effectively. A higher speed of the disc-cutters required to move the pulp fast leads to a high power consumption and goes against cost reduction.

Different kinds of heat dispersion machines are always used as a supplement of the hydrapulper for stripping the impurities on fiber which is applied in the Chinese patent CN2839340, a heat dispersion machine is disclosed therein, comprising a motor, a body having a discharge port, a stationary disc and a rotating disc arranged thereon, a feed system having a feed port arranged thereon and a base, wherein, a drive shaft having a rotating disc connected thereon fixedly connects with the motor shaft arranged on the motor. When the heat dispersion machine is running, fiber in the pulp is rubbing and moving by the cooperation of the stationary disc and the rotating disc to remove the impurities from the fiber. In order to have a sufficient contact of fibers, the pulp used in the heat dispersion machine has a high concentration which increases the running resistance, and an associated machine is used to concentrate the pulp suspension in advance which wastes lots of energy; in addition, the heat dispersion machine is generally used with the cooperation of chemical additives at high temperatures to resolve the impurities in the pulp having high concentration, which not only effects the performance of fiber, but also causes a lot of pollution.

To solve the above technical problems, the English patent GB2099325A disclosed a rotary strainer for fibrous pulp suspensions comprising a housing, a fixed cylindrical strainer arranged therein, an annular strainer chamber formed between the housing and the strainer, blades which rotate relative to the strainer basket about a substantially vertical axis arranged in the strainer and a pulp inlet arranged on the housing. The fibrous pulp suspension is supplied to the annular strainer chamber which narrows continuously in the flow direction from the same cross-section so as to avoid of the extraction of long fibers along with the waste matter from the outlet for impurities.

In the above technology, the strainer strains impurities from fibrous pulp suspensions supplied into the strainer and broken by the blades. This machine has a low consumption of energy and does not require high temperature and the chemical additives, however, the blades are just used for breaking the pulp, but not stripping impurities from fiber, so it cannot remove impurities from fiber effectively.

DETAILED DESCRIPTION

The technical problem to be solved by the invention is that the rotating blades cannot strip and remove impurities from fiber effectively, so a dispersion machine for removing impurities from fiber effectively is provided herein.

To solve the above technical problems, the invention provides a dispersion machine for removing impurities from fiber, comprising a housing, having a feed port and a discharge port arranged thereon, and a plurality of processing components arranged therein; wherein, each of the processing components comprises a connection portion and a scraping portion; the scraping portion is adapted for contacting with fiber and moving relatively to a surface of the fiber so as to remove impurities thereon; the minimum dimension of the scraping portion is smaller than or equal to 5 mm; the speed of the relative motion is higher than or equal to 3 m/s.

The minimum dimension of the scraping portion is 0.005-3 mm.

The speed of the relative motion is 20-300 m/s.

The processing components are blades and the scraping portions are the cutting edges of the blades.

The processing components are wire rods and the scraping portions are ends of the wire rods.

A rotating shaft with a gearing is arranged in the housing, and a plurality of processing components are arranged on the rotating shaft by the connection portions and rotate around the rotating shaft.

A plurality of processing components are arranged spirally along the rotating shaft.

A plurality of processing components are fixedly arranged in the housing by the connection portion, the feed port is arranged close to one end of the housing and the discharge port is arranged close to the other end thereof accordingly; the scraping portion is adapted for scraping the surface of the fiber when the fiber moves in the housing.

The dispersion machine further comprises a feed screw rod or a discharge screw rod arranged in the housing; the feed screw rod is arranged close to the feed port; the discharge screw rod is arranged close to the discharge port.

The scraping portions of the processing components (4) are densely arranged in parallel along the direction of feed.

Each of the processing component (4) is streamlined.

The concentration of the fiber pulp in the housing (1) is 0.5-20 v %.

The concentration of the fiber pulp in the housing (1) is 2-10 v %.

Compared with the prior art, the invention has the following technical effects:

(1) The dispersion machine for removing impurities from fiber in the invention, comprises a housing, having a feed port and a discharge port arranged thereon, and a plurality of processing components arranged therein; wherein, each of the processing components comprises a connection portion and a scraping portion; the scraping portion is adapted for contacting with fiber and moving relatively to a surface of the fiber so as to remove impurities thereon; the minimum dimension of the scraping portion is smaller than or equal to 5 mm; the speed of the relative motion is higher than or equal to 3 m/s.

The average length of the fiber in the material is about 1-3 mm, when the minimum dimension is less than or close to the average length, the scraping portion contacts with the surface of the fiber and generates relative motion of which the speed is controlled greater than or equal to 3 m/s, the impurities on the surface of the fiber can be removed by the scraping portion and the fibrous material with low impurity content can be got, so the technical problem that impurities cannot be removed from fiber in the existing technology because of the rotating blades is avoided. In addition, the fiber bundle mixed with the pulp can be scattered into independent fiber by the scraping portion of which the minimum dimension is less than or equal to 5 mm so as to get the fiber pulp without fiber bundle.

(2) The dispersion machine for removing impurities from fiber in the invention, the minimum dimension of the scraping portion is 0.005-3 mm and the speed of the relative motion is 20-300 m/s. Even the smaller the minimum dimension of the scraping portion is and the faster the speed of relative motion between the processing components and fibers is, the higher the efficiency of impurity removal from fiber is, but if the minimum dimension of the scraping portion is too small and the speed of the relative motion is too high, the fiber material with required length may not be got because the scraping portions would cut the fiber up. When the minimum dimension of scraping portion is 0.005-3 mm and the speed of the relative motion is 20-300 m/s, the scraping portions of processing components can remove more impurities from fiber and further reduce the impurity content, and the fiber would not be cut up, so the fiber material with lower impurity content and required length could be got.

(3) The dispersion machine for removing impurities from fiber in the invention, a rotating shaft with a gearing is arranged in the housing, and a plurality of processing components are arranged on the rotating shaft by the connection portions and rotate around the rotating shaft. The scraping portions of the processing components rotating around the rotating shaft contacts with and move relative to the fibers around the rotating shaft, so the impurities on the fibers can be removed evenly, the fibers all over the housing can be processed and the processing has no dead corner left.

(4) The dispersion machine for removing impurities from fiber in the invention, the processing components are blades or wire rods, accordingly, the scraping portions are the cutting edges of the blades or ends of the wire rods. Preferably, the processing components are blades or wire rods, the cutting edges or ends thereof are equivalent to the scraping portions, the thickness of the cutting edge or the diameter of the end of wire rod is the minimum structure of the scraping portion, if the dimension of the minimum structure is less than or equal to 5 mm, and the relative speed between blades or wire rods and the fiber pulp is greater than 3 m/s, then the impurities on the fiber can be scraped by the contact of the scraping portion with the surface of the fiber during the processing.

(5) The dispersion machine for removing impurities from fiber in the invention, further comprises a feed screw rod or a discharge screw rod arranged in the housing; the feed screw rod is arranged close to the feed port; the discharge screw rod is arranged close to the discharge port. When the feed screw rod is arranged close to the feed port and the discharge screw rod is arranged close to the discharge port, the screw rods can promote the feeding and discharging. In intermittent operation, the feed screw rod can return the processed fiber pulp to the processing components again to get reprocessing so that the efficiency of impurity removal from fiber can be improved.

(6) The dispersion machine for removing impurities from fiber in the invention, a plurality of processing components are fixedly arranged in the housing by the connection portion, the feed port is arranged close to one end of the housing and the discharge port is arranged close to the other end thereof accordingly; the scraping portion is adapted for scraping the surface of the fiber when the fiber moves in the housing. Keep the processing components fixed, when the fiber enters into the housing from the feed port and stays in motion, the scraping portions of the processing components can contact and scrap the surface of the fiber so as to remove the impurities from the fiber.

(7) The dispersion machine for removing impurities from fiber in the invention, the concentration of the fiber pulp in the housing is 0.5-20 v %. Preferably, the concentration of the fiber pulp in the housing is 2-10 v %. The dispersion machine herein removes impurities by adopting the scraping portions of the processing components to scrap the surface of the fiber, so even the concentration of the fiber pulp is lower, it can still remove impurities effectively, so as to overcome the problems that traditional heat dispersion machine utilizing the rubbing of the fibers in high concentration pulp to remove impurities that may bring about the problems such as great running resistance, high power consumption and high operation temperatures required.

BRIEF DESCRIPTION OF THE DRAWINGS

To make an easier understanding of the invention, the invention is further described in the following examples with reference to the drawings.

The appended drawing reference signs show: 1—housing, 2—feed port, 3—discharge port, 4—processing components, 5—rotating shaft, 6—motor, 7—baffle board, 8—feed screw rod, 9—discharge screw rod, and 10—gearing system.

DETAILED DESCRIPTION OF THE INVENTION

Example 1

Figure 1:
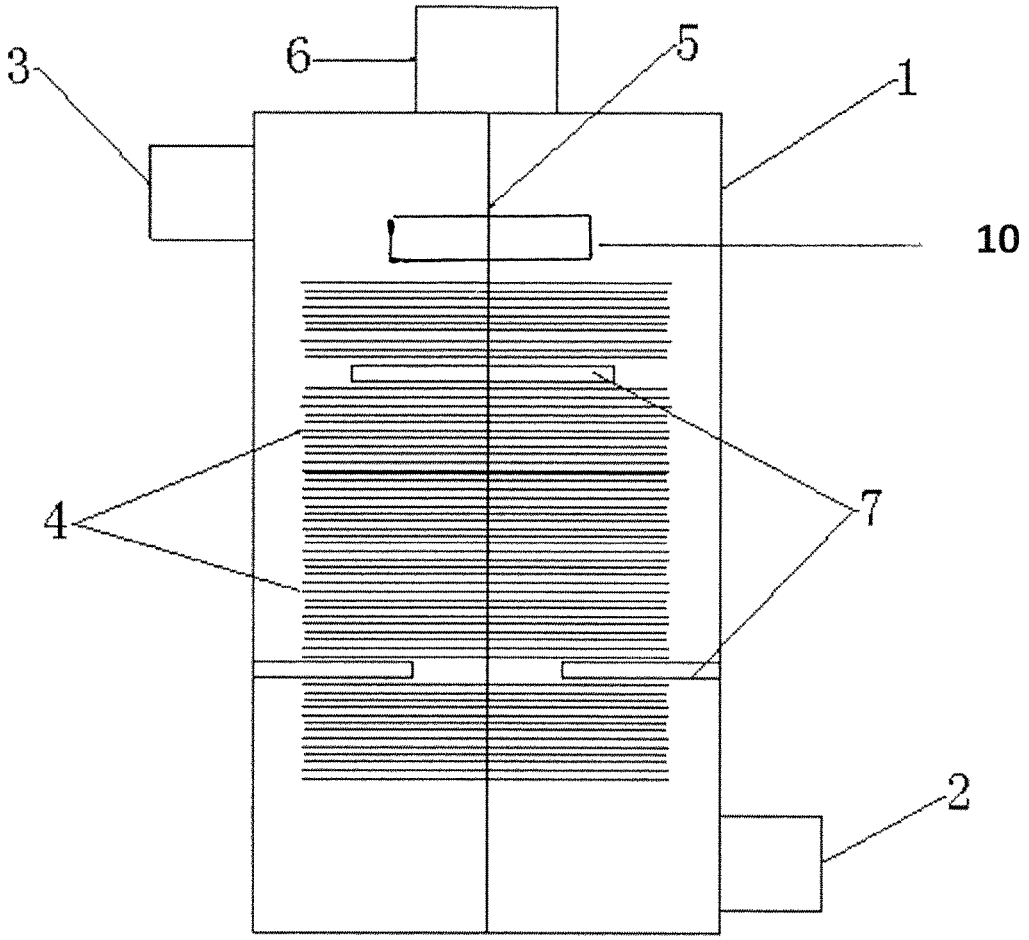
FIG.1 is a structural schematic diagram of the dispersion machine for removing impurities from fiber.

The dispersion machine for removing impurities from fibers in the invention shown as FIG.1, comprises a cylindrical housing 1 having a feed port 2 arranged on the lower part thereof, a discharge port 3 arranged on the upper part thereof, a rotating shaft provided with a gearing system 10 arranged in the center thereof with a motor 6 arranged on an upper side of the housing and a baffle board 7 arranged at a lower part of an inner wall of the housing and around the rotating shaft, the upper center of the housing also has a baffle board 7 arranged therein.

Processing components 4 are blades, five hundred blades are divided into several groups along the axial direction of the rotating shaft, wherein, the blades of each group are distributed horizontally along the circumferential direction of the rotating shaft and perpendicular to the rotating shaft; except the blade back connecting with the rotating shaft 5 as a connection portion, the thickness of the cutting edges of the blades is 0.005 mm; as a scraping portion, the linear speed of rotation of the cutting blades is 3-10 m/s.

When the apparatus is running, the fibers pulp of which the concentration is 0.5 v % enters the housing 1 through the feed port 2 arranged on the lower part of the housing 1. A plurality of blades are driven to rotate by the rotating shaft 5, the cutting blades contact with the surface of the fibers in the pulp and generate high speed motion relative to the fibers so as to scrap the impurities thereon, as a result, the impurities on most of the fibers in the pulp can be removed effectively.

Example 2

Figure 2:
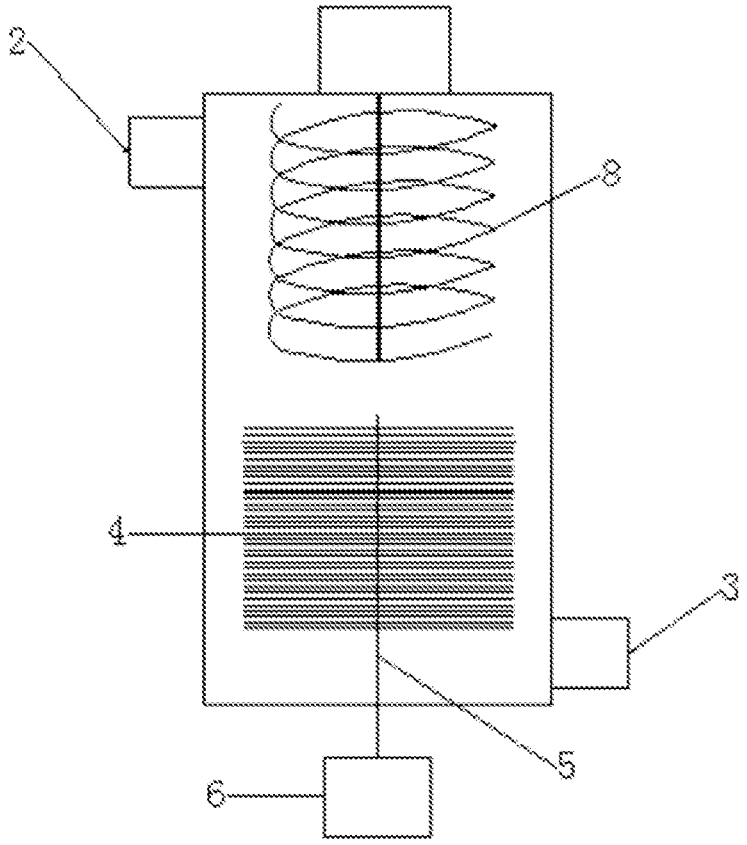
FIG.2 is a structural schematic diagram of the dispersion machine for removing impurities from fibers with a feed screw rod.

The dispersion machine for removing impurities from fibers in the invention shown as FIG. 2, comprises a cylindrical housing 1 having a rotating shaft arranged in the center thereof with a motor 6 arranged on the lower side of the housing, a feed port 2 arranged on the upper part thereof and a discharge port 3 arranged on the lower part thereof A feed screw rod arranged in the housing 1 and above the rotating shaft 5 is close to the feed port 2 and the motor of which is arranged on the upper side of the housing 1.

The processing components 4 are blades, five thousand of blades are divided into several groups along the axial direction of the rotating shaft, wherein, the blades of each group are distributed horizontally along the circumferential direction of the rotating shaft and perpendicular to the rotating shaft; except the blade back connecting with the rotating shaft 5 as a connection portion, the thickness of the cutting edges of the blades is 5 mm; as a scraping portion, the rotating speed of the cutting blades is 200-300 m/s.

When the apparatus is running, the feed screw rod is used to push down the pulp by choosing the continuous operation mode or the intermittent operation mode. Adopting the continuous operation, the fibers pulp whose concentration is 20 v % enters the housing 1 continually through the feed port 2 arranged on the upper part of the housing 1 and is pushed to the blades by the feed screw rod 8, the blades are driven by the rotating shaft 5 to rotate at high speed relative to fibers and contact with the surfaces of fibers so as to scrape the impurities on the surface of the fiber, then the processed fibers is discharged and collected from the discharge port on the lower part of the housing 1. Adopting the intermittent operation, the fibers pulp whose concentration is 20 v % enters the housing 1 continually through the feed port 2 arranged on the upper part of the housing 1 and is pushed to the blades by the feed screw rod 8, the blades are driven by the rotating shaft 5 to rotate at high speed relative to fibers and contact with the surfaces of fibers so as to scrape the impurities on the surface of the fiber, then part of the processed fibers is risen to the upper part of the housing 1 driven by the pulp, at the moment the feed screw rod 8 having the ability of pushing pulp returns this part of pulp to the blades to get reprocessing so that the effective of impurity removal from fibers can be improved. The fibers with low impurity content is discharged from the discharging port 3 then the fibers pulp to be processed inputted from the feeding port 2 repeats the above progress.

Example 3

Figure 3:
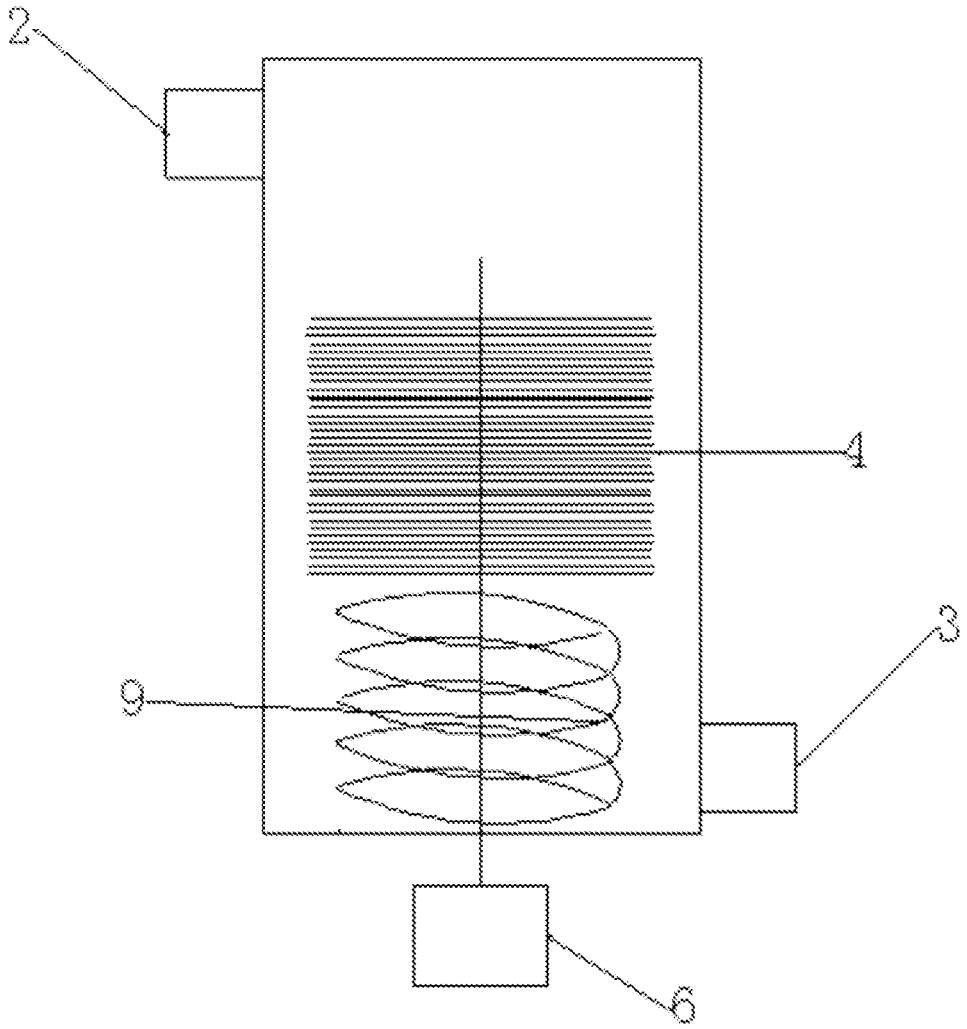
FIG.3 is a structural schematic diagram of the dispersion machine for removing impurities from fibers with a discharge screw rod.

The dispersion machine for removing impurities from fibers in the invention shown as FIG. 3, comprises a cylindrical housing 1 having a rotating shaft arranged in the lower center thereof with a motor 6 arranged on the lower side of the housing, a feed port 2 arranged on the upper part thereof and a discharge port 3 arranged on the lower part thereof A discharge screw rod 9 arranged in the housing 1 and under the rotating shaft 5 is close to the discharge port 3 and coaxial with the rotating shaft 5.

The processing components 4 are blades, fifty thousand blades are divided into several groups along the axial direction of the rotating shaft, wherein, the blades of each group are distributed horizontally along the circumferential direction of the rotating shaft and perpendicular to the rotating shaft 5; except the blade back connecting with the rotating shaft 5 as a connection portion, the thickness of the cutting edges of the blades is 3 mm; as a scraping portion, the rotating speed of the cutting blades is 50-100 m/s.

When the apparatus is running, the discharge screw rod 9 is used to push down the pulp, the fibers pulp whose concentration is 10 v % enters the housing 1 continually through the feed port 2 arranged on the upper part of the housing 1. A plurality of blades are driven by the rotating shaft 5 to rotate at high speed relative to fibers and contact with the surfaces of fibers so as to scrape the impurities on the surface of the fiber, and then the processed fibers pushed by the discharge screw rod 9 is discharged from the discharge port 3 on the lower part of the housing 1.

Example 4

Figure 4:
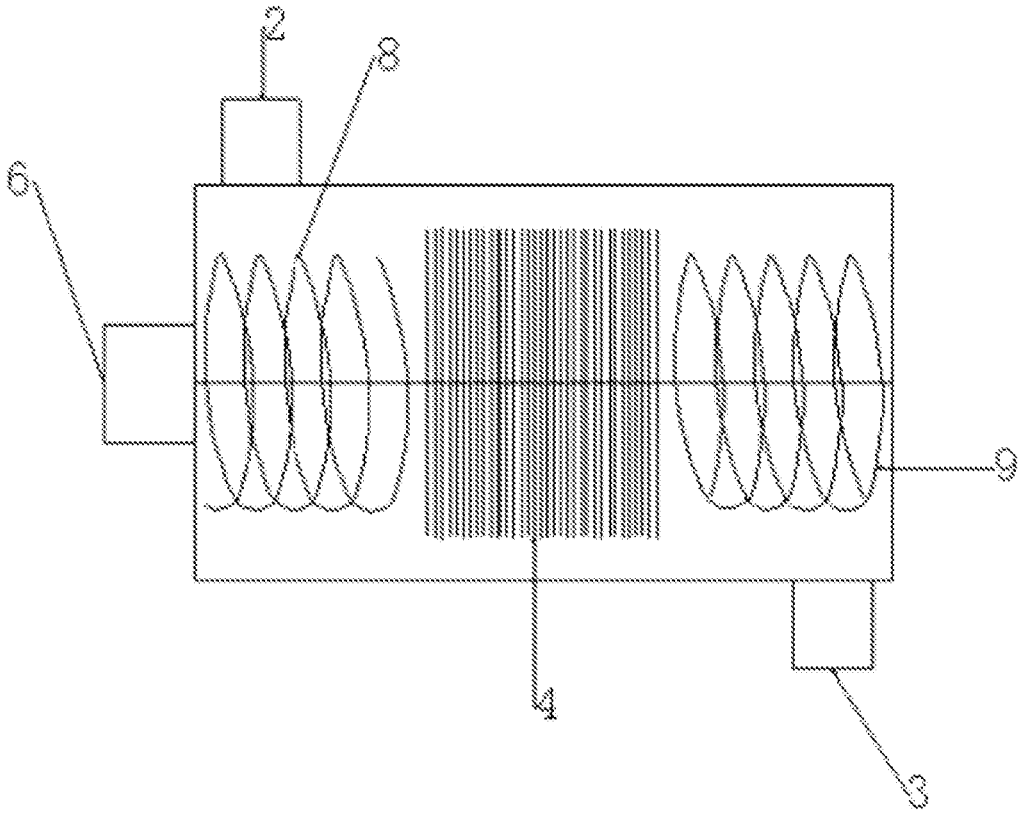
FIG.4 is a structural schematic diagram of the dispersion machine for removing impurities from fibers with a feed screw rod and a discharge screw rod arranged horizontally.

The dispersion machine for removing impurities from fibers in the invention shown as FIG. 4, comprises a cylindrical housing 1 having a rotating shaft 5 arranged in the center thereof with a motor 6 arranged on the outside of the housing; a feed screw rod is arranged on the left of the rotating shaft 5 and a discharge screw rod 9 is coaxial with the rotating shaft 5 in the housing 1; a feed port opening upward is arranged on the housing 1 close to the discharge screw rod 9, and a discharge port opening downward is arranged on the housing close to the feed screw rod 8.

The processing components 4 are blades, one hundred thousand blades are divided into several groups along the axial direction of the rotating shaft, wherein, the blades of each group are distributed vertically along the circumferential direction of the rotating shaft and perpendicular to the rotating shaft 5; except the blade back connecting with the rotating shaft 5 as a connection portion, the thickness of the cutting edges of the blades is 1 mm; as a scraping portion, the rotating speed of the cutting blades is 50-100 m/s.

When the apparatus is running, the feed screw rod 8 and the discharge screw rod 9 are both used to push the pulp to right, the fibers pulp whose concentration is 9 v % enters into the housing 1 continually through the feed port 2 and is pushed to the blades by the feed screw rod 8; A plurality of blades are driven by the rotating shaft 5 to rotate at high speed relative to fibers and contact with the surfaces of fibers so as to scrape the impurities on the surface of the fiber, and then the processed fibers pushed by the discharge screw rod 9 is discharged from the discharge port 3.

In the examples 1-4, a plurality of processing components can be arranged spirally along the rotating shaft 5 so as to push the flow of pulp in the housing 1. The processing components can be replaced with wire rods, plastic plates, nylon wires, etc, and the scraping portions of the processing components could be ends of wire rods, edges of the plastic plates or the ends of the nylon wires. Wherein, the arrangement of wire rods or nylon wires is that a plurality of wire rods or nylon wires are divided into several groups along the axial direction of the rotating shaft and the wire rods or nylon wires of each group are arranged vertically along the circumferential direction of the rotating shaft 5; the arrangement of plastic plates is that a plurality of plastic plates are divided into several groups along the axial direction of the rotating shaft 5 and the plastic plates of each group are arranged vertically along the circumferential direction of the rotating shaft 5.

Figure 5:
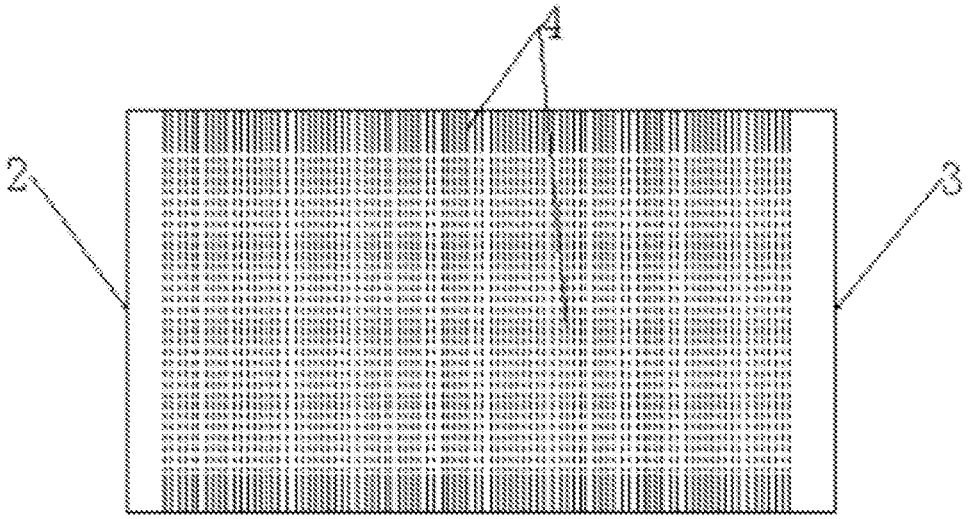
FIG.5 is a structural schematic diagram of the dispersion machine for removing impurities from fibers with feed screw rod with processing components arranged fixedly.
Figure 6:
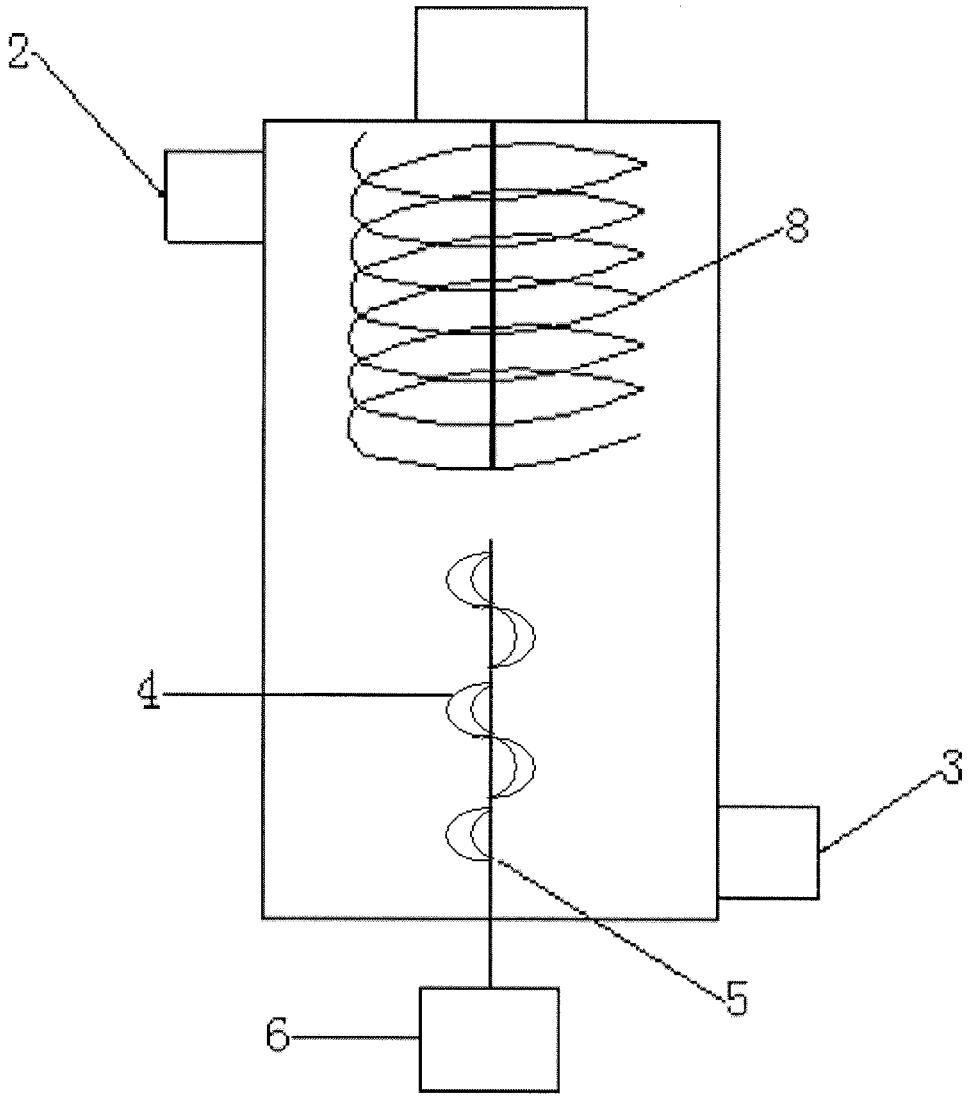
FIG. 6 is a structural schematic diagram of the dispersion machining containing a gearing system.

The dispersion machine for removing impurities from fibers in the invention shown as FIG. 5, comprises a cylindrical housing 1 having a feed port 2 arranged on one end thereof and a discharge port 3 arranged on the other end thereof.

The processing components 4 are blades, two hundred thousand blades are divided into several groups along the axial direction of the rotating shaft, the blades of each group are distributed vertically along the circumferential direction of the rotating shaft and perpendicular to the rotating shaft 5; except the blade back connecting with the inner wall of the housing 1 as a connection portion, the thickness of the cutting edges of the blades is 0.1 mm;

When the apparatus is running, the fibers pulp whose concentration is 2 v % enters into the housing 1 continually with the speed of 20 m/s through the feed port 2 arranged on one end of the housing 1. The fixed cutting blades rotate at high speed relative to fibers and contact with the surfaces of fibers so as to scrape most of the impurities on the surface of the fiber, and then the processed fibers pulp is discharged from the discharge port 3 arranged on the other end of the housing 1.

In the example, the processing components 4 can be replaced with wire rods, plastic plates, nylon wires, etc, and the scraping portions of the processing components could be ends of wire rods, edges of the plastic plates or the ends of the nylon wires. Wherein, the arrangement of wire rods or nylon wires is that a plurality of wire rods or nylon wires are divided into several groups along the axial direction of the housing 1 and the wire rods or nylon wires of each group are distributed along the inner circumferential direction of the housing land perpendicular to the inner wall; the arrangement of plastic plates is that a plurality of plastic plates are divided into several groups along the axial direction of the housing 1 and the plastic plates of each group are arranged vertically along the circumferential direction of the inner wall of the housing 1.

Preferably, each of the processing components is streamlined so as to reduce the resistance with the fibers pulp; the streamlined processing component means that the surface thereof is smooth, the line thereof is fluent and is not undulate greatly. The major performance of the fluid on the processing components is laminar flow so as to reduce the resistance from the fluid.

The processing components 4 in the above examples can be replaced with others types of processing components, and the quantity, shape and arrangement can be selected randomly based on the actual situation within the limits of the invention. The scraping portion of the processing components should adopt the materials with hardness and no plastic deformation occurred; the motor 6 can be displaced with other gearing.

The dispersion machine for removing impurities from fibers can be used to process the fibers pulp with not only middle and low concentration but also high concentration.

Even the invention has been described in detail by the examples described above, for persons having ordinary skill in the art, different kinds of changes in any form or detail could be made based on the teachings provided and not exceeding the claims of right are still in the protection scope of this invention.

The invention claimed is:

1. A dispersion machine for removing impurities from fiber, comprising a housing, having a feed port at one end and a discharge port at the other end;

a plurality of cutting blades rotatably and axially disposed between the feed port and the discharge port, and at least one of feed screw rods and/or discharge screw rods is coaxially disposed with the plurality of cutting blades in the housing between the feed port and the cutting blade and/or between the discharge port and the cutting blades, respectively, wherein each of the cutting blades comprises a connecting portion and a scraping portion, the scraping portion being adapted for contacting the fiber and providing a motion relative to a surface of the fiber so as to remove impurities thereon, and wherein the minimum dimension of the scraping portion is smaller than or equal to 5 mm; and the speed of motion of the scraping portion relative to the surface of the fiber is higher than or equal to 3 m/s.

2. The dispersion machine of claim 1, wherein, the minimum dimension of the cutting blade is 0.005-3 mm.

3. The dispersion machine of claim 1, wherein, the speed of the relative motion is 20-300 m/s.

4. The dispersion machine of claim 1, wherein, the scraping portion is the cutting edges of the blades.

5. The dispersion machine of claim 1, wherein, the cutting blades are wire rods and the scraping portions are the ends of the wire rods.

6. The dispersion machine of claim 1, wherein, the cutting blades are disposed on a rotating shaft provided with a gearing system arranged in the housing, and a plurality of the cutting blades are arranged on the rotating shaft by the connecting portions and rotate with the rotating shaft.

7. The dispersion machine of claim 5, wherein, the plurality of cutting blades are arranged spirally along the rotating shaft.

8. The dispersion machine of claim 1, wherein, the plurality of cutting blades are fixedly arranged in the housing by the connecting portion, and the scraping portion is adapted for scraping the surface of the fiber as the fiber moves in the housing.

9. The dispersion machine of claim 1, wherein, the scraping portions of the cutting blades are densely arranged in parallel along the direction of feed.

10. The dispersion machine of claim 1, wherein, each of the cutting blades is streamlined.

11. The dispersion machine of claim 1, wherein, the concentration of the fiber pulp in the housing is 0.5-20 v %.

12. The dispersion of claim 11, wherein, the concentration of the fiber pulp in the housing is 2-10 v %.

13. The dispersion machine of claim 1, wherein the minimum dimension of the scraping portion is 0.005-3 mm and the speed of the relative motion is 20-300 m/s.

* * * * *